US006997218B1

(12) United States Patent
Garcia et al.

(10) Patent No.: US 6,997,218 B1
(45) Date of Patent: Feb. 14, 2006

(54) INFLATABLE BODY ARMOR SYSTEM

(75) Inventors: Felipe Garcia, Panama City, FL (US); Robert Woodall, Panama City Beach, FL (US); Christopher Doyle, Panama City Beach, FL (US); Greg Reitmeyer, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 110 days.

(21) Appl. No.: 10/828,522

(22) Filed: Apr. 8, 2004

(51) Int. Cl.
*B65B 1/04* (2006.01)

(52) U.S. Cl. ..... 141/98; 2/2.5; 2/DIG. 3; 428/911; 89/36.05; 441/107

(58) Field of Classification Search ..... 141/98, 141/38, 114; 2/2.5, 900, DIG. 3, 244; 428/911; 89/36.05; 441/107
See application file for complete search history.

(56) References Cited

U.S. PATENT DOCUMENTS

| | | | | |
|---|---|---|---|---|
| 5,584,737 | A * | 12/1996 | Luhtala | 441/107 |
| 6,012,162 | A * | 1/2000 | Bullat | 2/2.5 |
| 6,079,056 | A * | 6/2000 | Fogelberg | 2/461 |
| 6,845,513 | B1 * | 1/2005 | Field et al. | 2/2.5 |
| 6,861,378 | B1 * | 3/2005 | Cunningham et al. | 442/135 |

* cited by examiner

*Primary Examiner*—Steven O. Douglas
(74) *Attorney, Agent, or Firm*—James T. Shepherd

(57) ABSTRACT

An inflatable body armor system has one or more body armor sections adapted to be worn by a user. Each body armor section includes (i) a inflatable flexible/sealable plenum, (ii) a ballistic armor fabric encasing the plenum, and (iii) a variety of lines, shaped objects and/or fabric sheets dispersed in the plenum to alter the trajectory of a projectile entering the plenum.

27 Claims, 3 Drawing Sheets

INFLATABLE BODY ARMOR SYSTEM

ORIGIN OF THE INVENTION

The invention described herein was made in the performance of official duties by employees of the Department of the Navy and may be manufactured, used, licensed by or for the Government for any governmental purpose without payment of any royalties thereon.

CROSS-REFERENCE TO RELATED PATENT APPLICATIONS

This patent application is co-pending with one related patent application entitled "INFLATABLE TRAJECTORY ALTERING AND BLAST ENERGY ABSORPTION SYSTEM" (Navy Case No. 96127) by the same inventors as this patent application.

FIELD OF THE INVENTION

The invention relates generally to body armor, and more particularly to an inflatable body armor system that alters a projectile's trajectory as the projectile passes through an inflated plenum.

BACKGROUND OF THE INVENTION

In today's world, police and military forces frequently wear some form of body armor in order to reduce the threat of severe injury or death due to an incoming projectile. Current body armor technology utilizes layers of fabrics made from aramids (e.g., SPECTRA, KEVLAR, etc.), polypropylene, polyethylene, or high-performance P-phenylene benzobisoxazole (PBO) fibers. The fabric materials can be used alone or have ceramic panels positioned between material layers sewn into a vest type arrangement to surround the front and back of a person's upper torso. In the current art, the only methods used to increase body armor's ballistic protection involve (i) adding thick metal plates, ceramic plates, or other hard materials, or (ii) increasing the thread count and number of layers of fabric material. However, both methods increase the weight and cost of the body armor.

SUMMARY OF THE INVENTION

Accordingly, it is an object of the present invention to provide a body armor system that offers the wearer protection from an incoming projectile.

Another object of the present invention is to provide a lightweight body armor system.

Other objects and advantages of the present invention will become more obvious hereinafter in the specification and drawings.

In accordance with the present invention, an inflatable body armor system includes at least one body armor section adapted to be worn by a user. Each body armor section includes a flexible/sealable plenum defined by spaced apart walls when the plenum is inflated, and a ballistic armor fabric encasing the plenum. Dispersed in the plenum are tensioned lines, shaped objects and/or ballistic fabric sheets for altering trajectory of a projectile entering the plenum.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Prior to describing the inflatable body armor system of the present invention, a novel inflatable trajectory altering system will first be described. The trajectory altering system forms the core element for the inflatable body armor system.

Figure 1:
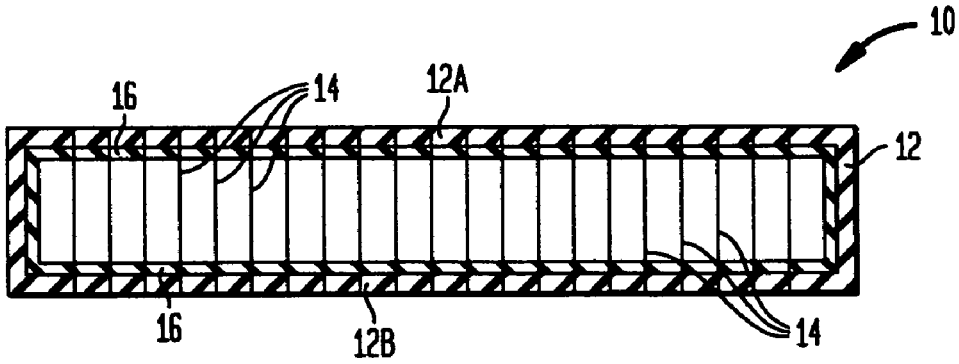
FIG. 1 is a cross-sectional view of one embodiment of an inflatable trajectory altering system used in the inflatable body armor system of the present invention.

Referring now to the drawings, and more particularly to FIG. 1, one embodiment of an inflatable trajectory altering system of the present invention is shown in its inflated state and is referenced generally by numeral 10. System 10 has an outer wall structure 12 made from a flexible and fluid-impermeable material that defines a plenum. More specifically, wall structure 12 has major opposing walls 12A and 12B that are spaced apart from one another when the interior volume defined by wall structure 12 is inflated with a lightweight fluid such as air. The means used to inflate wall structure 12 can be any compressed air (or other fluid) inflation system and is not a limitation of the present invention. Inflation of system 10 can occur just prior to use thereof or during the manufacture thereof without departing from the scope of the present invention. Also, the material used for wall structure 12 can be selected from a wide variety of well known flexible and fluid-impermeable materials and is, therefore, not a limitation of the present invention.

In general, the trajectory altering system of the present invention includes one or more types of material structures disposed within wall structure 12. For the illustrated embodiment, flexible lines 14 are coupled to and span major opposing walls 12A and 12B such that lines 14 are placed in tension when wall structure 12 is inflated. Each of lines 14 can be made from a single fiber strand or multiple strands of fiber. In general, lines 14 should possess a high tensile strength and be abrasion resistant. Thus, a variety of polymer materials can be used for lines 14 with certain commercially-available products being preferred when system 10 is to be used to alter the trajectory of an incoming projectile. For example, lines 14 can be fibers made from the well-known polymeric strength materials SPECTRA available from Honeywell International Inc., KEVLAR available from E.I. du Pont de Nemours and Company, ZYLON available from Toyobo Company Ltd., TWARON available from Akzo Nobel, DYNEEMA available from Koninklijke DSM N.V., and nylon, just to name a few.

Attachment of lines 14 to major opposing walls 12A and 12B is preferably accomplished by a method known as "drop stitching" which maintains the sealed and fluid-impermeable integrity of wall structure 12. Drop stitching methods are known in the art of inflatable watercraft construction. See, for example, U.S. Pat. No. 6,074,261, the contents of which are hereby incorporated by reference. The lengths of lines 14 can be varied to shape the outer contours of wall structure 12 for a particular application.

The interior surfaces of wall structure 12 can be optionally coated or covered with a viscous polymeric sealing material layer 16 that serves to seal itself in the event of a small puncture. Examples of such sealing material constructions are disclosed in U.S. Pat. Nos. 4,501,035 and 5,295,525, the contents of which are hereby incorporated by reference.

Figure 2:
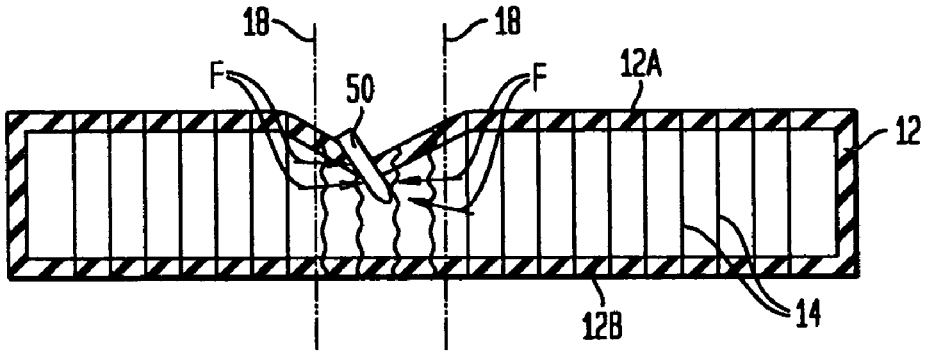
FIG. 2 depicts a view of the trajectory altering system of FIG. 1 immediately after a projectile has punctured one wall thereof.

The mechanism by which system 10 alters a projectile's trajectory will now be described with the aid of FIG. 2 where a projectile 50 is shown after it pierces major wall 12A but before it reaches major wall 12B. For clarity of illustration, polymeric sealing material 16 has been omitted from FIG. 2 and each of the other illustrated embodiments of the present invention that will be discussed later herein. Those of lines 14 that are in line with or immediately adjacent to the point of impact of projectile 50 tend to break or relax (within the region between dashed lines 18). However, due to the inflation of wall structure 12, those of lines 14 surrounding relaxed region 18 experience a greater amount of tension as they are drawn towards region 18 and projectile 50. As a result, forces F are applied to projectile 50 from circumferential points thereabout.

The action of circumferential forces F tends to alter the trajectory of projectile 50 thereby causing projectile 50 to encounter more of lines 14. That is, forces F cause projectile 50 to experience yaw with respect to its original straightline course thereby making projectile 50 collide with more of lines 14. Simultaneously, the change in projectile trajectory increases the projectile's force bearing area which reduces the projectile's localized pressure point to immediately reduce the projectile's penetration capability. Thus, more collisions translate to more projectile course alterations and increased projectile bearing area resulting in increased energy losses.

Trajectory alteration also dissipates large amounts of the projectile's kinetic energy in lines 14 as the larger projectile bearing area impinges on lines 14. In addition, the subsequent movement of the impacted wall(s) absorb kinetic energy in a way not conducive to penetration thereby slowing the speed of projectile 50 and reducing its lethality.

In addition, the present invention mitigates the shock wave resulting from a blast event. For many battlefield situations, this type of shock wave typically lasts for less than 30 milliseconds. The impedance mismatch between major walls 12A and 12B combined with the ability of the plenum to deform upon shock wave arrival reduces the intensity of these short-lived blast-induced shock waves impinging on the wall structure. More specifically, the impedance mismatch and flexible plenum make the present invention respond to a short-lived shock wave in a non-frangible and flexible way. As a result, a short-lived blast-induced shock wave can be absorbed during its brief period of lethality. Still further, the two spaced apart walls of wall structure 12 will aid in the jet particulation of an exploded shaped charge warhead.

Figure 3:
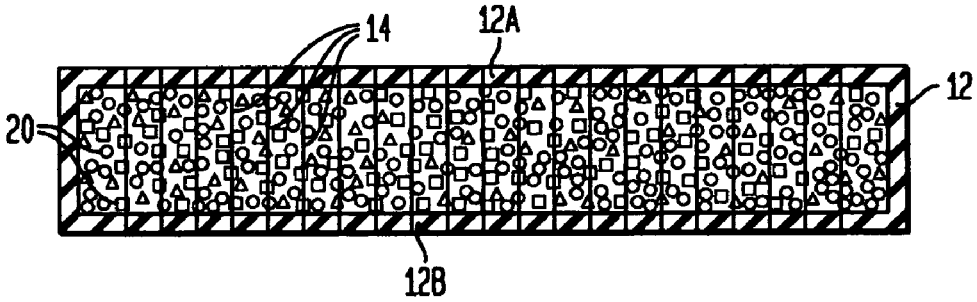
FIG. 3 is a cross-sectional view of another embodiment of the inflatable trajectory altering system that includes shaped objects therein.

Projectile trajectory alteration and energy absorbing capabilities can be further enhanced by adding other material structures within wall structure 12. Several examples will be described below with the aid of FIGS. 3–7. In FIG. 3, a plurality of small lightweight shaped objects 20 can partially or completely fill wall structure 12. Objects 20 can be solid or hollow, and can be made from a hard lightweight material such as a ceramic material. Objects 20 can be shaped as spheres, cubes, pyramids, irregular shapes, or mixtures thereof, without departing from the scope of the present invention. For example, it is known that bi-modal distribution of small and large particles allows for more particles to be packed into a small volume thereby increasing resistance to penetration by a projectile. Thus, in general, the presence of objects 20 increases the amount of material available to absorb a projectile's energy and increases the surface area of the projectile due to mechanical damage as its trajectory is altered within wall structure 12. Note that another embodiment could make use of a wall structure 12 partially or completely filled with objects 20 without the use of any lines 14.

Figure 4:
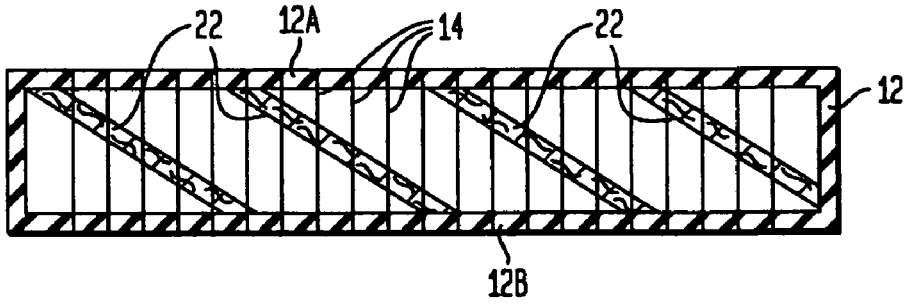
FIG. 4 is a cross-sectional view of another embodiment of the inflatable trajectory altering system that includes the use of ballistic armor fabric sheets.
Figure 5:
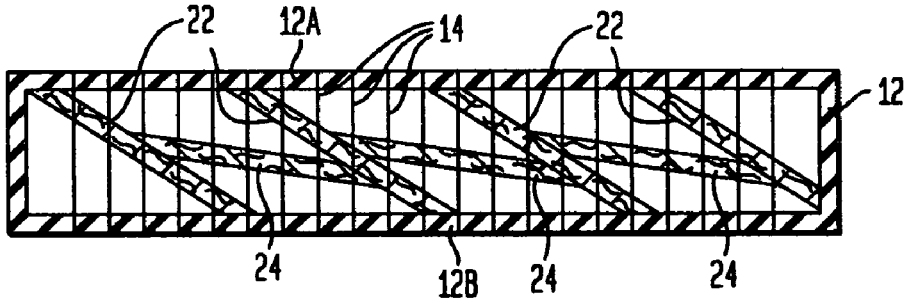
FIG. 5 is a cross-sectional view of another embodiment of the inflatable trajectory altering system that includes the use of a matrix of ballistic armor fabric sheets.
Figure 6:
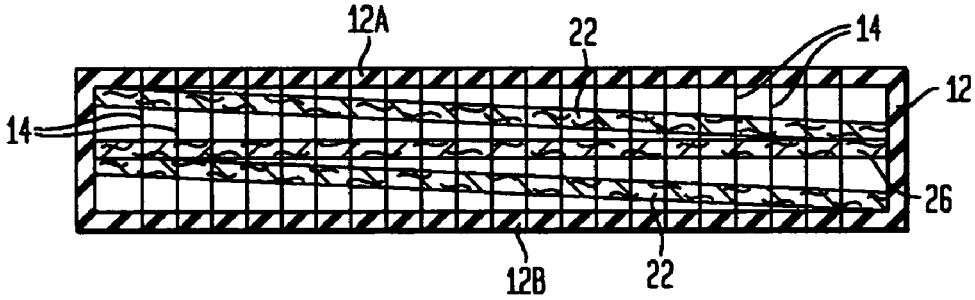
FIG. 6 is a cross-sectional view of another embodiment of the inflatable trajectory altering system that includes the use of a matrix of ballistic armor fabric sheets.

FIGS. 4–6 illustrate embodiments of the trajectory altering system that include the use of ballistic armor fabric sheets within wall structure 12. As used herein, the term "ballistic armor fabric sheet" refers to any flexible but high-strength fabric that is accepted as having ballistic protection properties in the field of ballistic protection systems. Currently, such fabrics include the previously-mentioned SPECTRA, KEVLAR, TWARON and DYNEEMA. However, it is to be understood that the present invention could utilize other ballistic armor fabric sheets as such are developed.

In FIG. 4, a plurality of ballistic armor fabric sheets 22 are arranged within wall structure 12 in a spaced-apart and substantially parallel fashion to form an angular relationship with lines 14 when lines 14 are in tension. Ends of sheets 22 can be coupled to wall structure 12 in a variety of ways. For example, the ends of sheets 22 can be adhered to wall structure 12 with an adhesive and then stitched in place when lines 14 are stitched in. Lines 14 are passed through sheets 22 during the stitching process. The presence of sheets 22 aids in altering a projectile's trajectory and absorbs energy from the projectile. Specifically, when an incoming projectile impinges on a sheet 22, the sheet deflects to absorb energy and defines an angular path for the projectile to follow. If/when a projectile passes through one of sheets 22, the projectile encounters another sheet 22 where its trajectory is again altered and its energy is absorbed.

In FIG. 5, sheets 22 are tethered to one another by ballistic armor fabric sheets 24 that are angularly disposed with respect to lines 14 and sheets 22. As a result, sheets 22 and 24 form a matrix of sheets that lie on different angles for trajectory alteration. FIG. 6 depicts a similar concept with sheets 26 (only one sheet 26 is shown for clarity of illustration) being interspersed with sheets 22 and substantially parallel to major opposing walls 12A and 12B.

Figure 7:
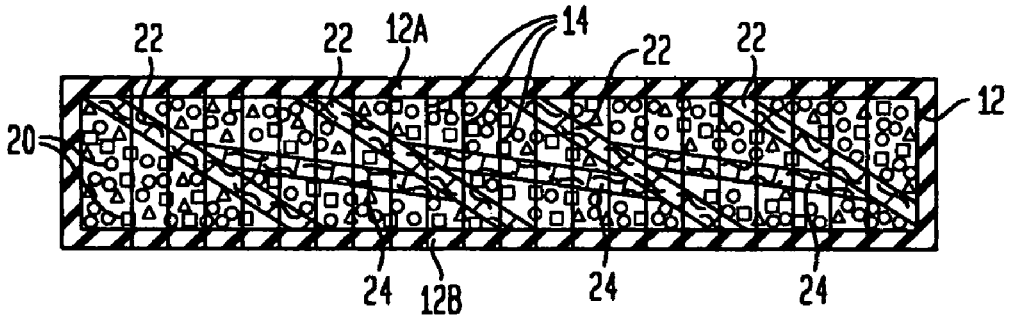
FIG. 7 is a cross-sectional view of another embodiment of the inflatable trajectory altering system that includes the use of shaped objects and a matrix of ballistic armor fabric sheets.

Each of the embodiments shown in FIGS. 4–6 could further include shaped objects partially or completely filling the interior of the wall structure. For example, FIG. 7 illustrates the FIG. 5 embodiment and further includes shaped objects 20 within wall structure 12. Furthermore, each of the embodiments depicted in FIGS. 4–7 could be implemented without the use of lines 14.

One or more of the above-described inflatable trajectory altering systems can be utilized in the construction of an inflatable body armor system in accordance with the present invention. The body armor system can be constructed to fit any portion of one's body, although it is typically constructed as a vest as will be described herein by way of example. Accordingly, it is to be understood that the inflatable body armor vest described herein is simply a representative example and is not a limitation of the present invention.

Figure 8:
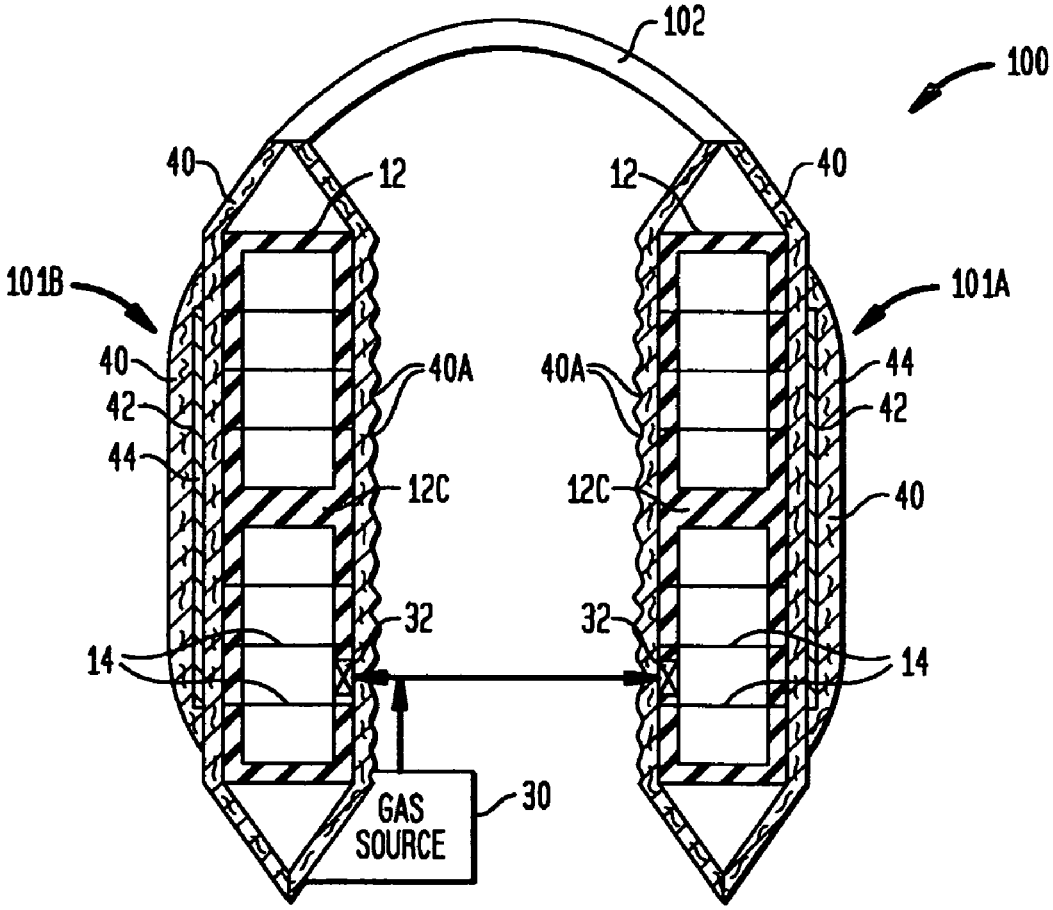
FIG. 8 is a side, cross-sectional view of one embodiment of an inflatable body armor system in accordance with the present invention.

Referring now to FIG. 8, an inflatable body armor vest in accordance with the present invention is shown and is referenced generally by numeral 100. In the illustrated embodiment, body armor vest 100 includes a front 101A and a rear 101B held together by straps 102 that would drape over and rest on a user's shoulders. The inflatable portion of front 101A and rear 101B is constructed from one of the above-described inflatable trajectory altering systems.

By way of example, body armor vest 100 is shown using the inflatable trajectory altering system shown in FIG. 1 (without polymeric sealing material 16 for simplicity of illustration) with common reference numerals being used to describe the common elements thereof. For on-demand inflation, a compressed gas source 30 (e.g., a $CO_2$ cartridge) is coupled to wall structure 12 by a valve 32. In cases where vest 100 is also serving as a flotation device, gas source 30 could be a water-actuated pressurized gas release device that (preferably) would also include manual means of inflation. One such device is disclosed in U.S. Pat. No. 5,311,394.

To provide inflation integrity in the event of a leak in wall structure 12, the interior portion of wall structure 12 can be divided into individual sealed chambers separated by chamber walls 12C. As would be well understood in the art, each of chamber walls 12C can incorporate a "one way valve" (not shown) to permit system inflation from a single gas source 30.

Each wall structure 12 is encased by fabric 40 having ballistic armor qualities. Currently, the preferred materials for fabric 40 are SPECTRA and KEVLAR. Panels of fabric 40 can be stitched to encase each wall structure 12. Fabric 40 can also be used to define pockets 42 designed to receive conventional rigid armor plates 44 (e.g., metal, ceramic, etc.).

The portion of fabric 40 that will come into contact with a user can be quilted or dimpled at 40A to define a three-dimensional surface that creates air gaps between fabric 40 and the user's body. The air gaps will keep a user cool during an extended wearing of vest 100.

The advantages of the present invention are numerous. The inflatable body armor system provides ballistic protection as tensioned flexible members (e.g., lines and/or fabric sheets) dispersed in the body armor's inflated plenum serve to alter an incoming projectile's trajectory while simultaneously absorbing the kinetic energy thereof. The inflated nature of the body armor makes it lightweight and buoyant. By dividing the inflated plenum into individual chambers, the body armor will not be compromised by a single point failure. In addition, the present invention mitigates shock resulting from a blast event.

The present invention provides the means to build body armor panels of relatively great thickness and relatively low weight. Armor thickness is of great importance as it is the only means available to overcome the basic thermodynamic limitation imposed by the fact that it takes time to transfer/absorb energy/work. Thus, a thicker armor provides the time necessary to effect energy transfer/absorption of a projectile or blast energy.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed is:

1. An inflatable body armor system, comprising:

at least one body armor section adapted to be worn by a user, each said body armor section including a flexible and sealable plenum defined by spaced apart walls when said plenum is inflated, a ballistic armor fabric encasing said plenum, and means, dispersed in said plenum, for altering trajectory of a projectile entering said plenum.

2. An inflatable body armor system as in claim 1 wherein said means for altering comprises a plurality of flexible lines coupled to said walls of said plenum, said plurality of flexible lines being placed in tension when said plenum is inflated.

3. An inflatable body armor system as in claim 2 wherein said means for altering further comprises a plurality of shaped objects in said plenum.

4. An inflatable body armor system as in claim 3 wherein each of said plurality of shaped objects comprises a ceramic object.

5. An inflatable body armor system as in claim 3 wherein said means for altering further comprises a plurality of ballistic armor fabric sheets in said plenum with said plurality of flexible lines passing therethrough.

6. An inflatable body armor system as in claim 5 wherein said plurality of ballistic armor fabric sheets are disposed at a plurality of angles relative to said walls of said plenum.

7. An inflatable body armor system as in claim 1 wherein said means for altering comprises a plurality of shaped objects in said plenum.

8. An inflatable body armor system as in claim 7 wherein each of said plurality of shaped objects comprises a ceramic object.

9. An inflatable body armor system as in claim 7 wherein said means for altering further comprises a plurality of ballistic armor fabric sheets in said plenum.

10. An inflatable body armor system as in claim 9 wherein said plurality of ballistic armor fabric sheets are disposed at a plurality of angles relative to said walls of said plenum.

11. An inflatable body armor system as in claim 2 wherein said means for altering further comprises a plurality of ballistic armor fabric sheets in said plenum with said plurality of flexible lines passing therethrough.

12. An inflatable body armor system as in claim 11 wherein said plurality of ballistic armor fabric sheets are disposed at a plurality of angles relative to said walls of said plenum.

13. An inflatable body armor system as in claim 1 wherein said means for altering comprises a plurality of ballistic armor fabric sheets mounted in and coupled to said plenum.

14. An inflatable body armor system as in claim 13 wherein said plurality of ballistic armor fabric sheets are disposed at a plurality of angles relative to said walls of said plenum.

15. An inflatable body armor system as in claim 2 wherein each of said plurality of flexible lines comprises at least one fiber.

16. An inflatable body armor system as in claim 1 further comprising a polymeric sealing material coupled to each of said walls of said plenum for sealing punctures therein.

17. An inflatable body armor system as in claim 1 wherein said plenum is divided into a plurality of sealable chambers.

18. An inflatable body armor system as in claim 1 wherein, at a portion thereof that will come into contact with the user when said body armor section is worn by the user, said ballistic armor fabric presents a three-dimensional surface wherein air gaps are created between said surface and the user.

19. An inflatable body armor system, comprising:

at least one body armor section adapted to be worn by a user, each said body armor section including a flexible and sealable plenum defined by spaced apart walls when said plenum is inflated, a ballistic armor fabric encasing said plenum, and a plurality of flexible members disposed in said plenum and coupled thereto that are placed in tension when said plenum is inflated.

20. An inflatable body armor system as in claim 19 further comprising a plurality of shaped objects in said plenum.

21. An inflatable body armor system as in claim 20 wherein each of said plurality of shaped objects comprises a ceramic object.

22. An inflatable body armor as in claim 19 wherein said plurality of flexible members comprises one of (i) fibers, (ii) fibers and ballistic armor fabric sheets, and (iii) ballistic armor fabric sheets.

23. An inflatable body armor system as in claim 22 further comprising a plurality of shaped objects in said plenum.

24. An inflatable body armor system as in claim 23 wherein each of said plurality of shaped objects comprises a ceramic object.

25. An inflatable body armor system as in claim 19 further comprising a polymeric sealing material coupled to said walls of said plenum for sealing punctures therein.

26. An inflatable body armor system as in claim 19 wherein said plenum is divided into a plurality of sealable chambers.

27. An inflatable body armor system as in claim 19 wherein, at a portion thereof that will come into contact with the user when said body armor section is worn by the user, said ballistic armor fabric presents a three-dimensional surface wherein air gaps are created between said surface and the user.

* * * * *